US005579559A

United States Patent [19]

Ferrario

[11] Patent Number: 5,579,559

[45] Date of Patent: Dec. 3, 1996

[54] BRACELET CLASP OF THE UNFOLDING BUCKLE TYPE

[75] Inventor: Luigi Ferrario, Hauterive, Switzerland

[73] Assignee: Gay Freres S. A., Geneve, Switzerland

[21] Appl. No.: 379,596

[22] Filed: Feb. 2, 1995

[30] Foreign Application Priority Data

Jun. 3, 1993 [FR] France ..... 93 06755

[51] Int. Cl.[6] ..... A44C 5/24

[52] U.S. Cl. ..... 24/71 J; 24/265 WS

[58] Field of Search ..... 24/68 J, 69 J, 24/70 J, 71 J, 71 SK, 71 TD, 71 SB, 71 ST, 71 R; 403/96

[56] References Cited

U.S. PATENT DOCUMENTS

| | | | |
|---|---|---|---|
| 1,732,508 | 10/1929 | Farris | 403/96 |
| 2,444,360 | 6/1948 | Mauch . | |
| 2,518,551 | 8/1950 | Jaccarino . | |
| 4,881,776 | 11/1989 | Wang | 403/96 X |
| 5,331,723 | 7/1994 | Mathieu . | |

FOREIGN PATENT DOCUMENTS

| | | | |
|---|---|---|---|
| 208168 | 1/1987 | European Pat. Off. | 24/265 WS |
| 0509938 | 10/1992 | European Pat. Off. . | |
| 41123 | 12/1932 | France . | |
| 2619292 | 2/1989 | France | 24/265 WS |
| 353567 | 5/1961 | Switzerland | 24/71 J |
| 633698 | 12/1982 | Switzerland . | |
| 739748 | 11/1955 | United Kingdom | 24/71 J |

*Primary Examiner*—Peter M. Cuomo
*Assistant Examiner*—Hanh Tran
*Attorney, Agent, or Firm*—Pollock, Vande Sande & Priddy

[57] ABSTRACT

A clasp of the unfolding buckle type comprises a branch and an arm hinged at one of its ends to a first end of the branch. The branch has a lateral side face arranged opposite a lateral side face of the arm in a closed position of the clasp, and the clasp includes an elastically deformable element for jamming the clasp in the closed position. The elastically deformable element in the closed position of the clasp extends into a housing formed by a longitudinal hollow provided in the lateral side face of the branch and by a longitudinal hollow provided in the lateral side face of the arm.

20 Claims, 5 Drawing Sheets

BRACELET CLASP OF THE UNFOLDING BUCKLE TYPE

FIELD OF THE INVENTION

The invention concerns a clasp of the unfolding buckle type for bracelets, in particular for a watch bracelet and, more specifically, such a clasp including at least one branch, at least one arm hinged at a first of its ends to a first end of said branch, said branch having a lateral face arranged opposite a lateral face of said arm in the closed position of the clasp and means for maintaining said clasp in said closed position.

BACKGROUND OF THE INVENTION

A clasp responding to the generic definition hereinabove is described in patent document EP-A-0 509 938. In this document, the clasp comprises two arms which are hinged to bracelet strands at one of their ends and at their other end to ends of two branches parallel to a central element in stretcher form. The central element exhibits two notches having a form and dimensions corresponding to those of the arms so that the arms are entirely included within the notches in the closed position of the bracelet. Latching the bracelet in its closed position is assured by a snap system. In order to assure such latching, the end of the arm which is attached to the strand exhibits a beak, one of the parts of which exhibits a groove which cooperates with a cylindrical element or bridge connecting the branches after they have been elastically engaged onto this latter.

This latching system has the drawback of being subject to rapid wear which has as result that the clasp is no longer effectively assured after a certain number of openings and closings.

Such rapid wear also leads to considerable variations in the opening and closing forces which is unsatisfactory for the user, such forces being furthermore dependent on the nature of the materials used for forming the clasp.

To this is added the inherent play existing between the groove and the cylindrical element which gives an impression of indifferent quality to this latching system.

For the rest, such clasp is relatively difficult to form with precision since it requires numerous mechanical operations, in particular touch up machining following stamping out of the branches and the arms and the adjustment of the beak with the bridge prior to assembly of the clasp in order to obtain an acceptable opening force and closing force.

SUMMARY OF THE INVENTION

The invention thus has as its main purpose to overcome the drawbacks of the prior art mentioned hereinabove by furnishing a clasp of the unfolding buckle type for a bracelet comprising a reliable system for maintaining the clasp in its closed position and which, while conferring an improved design aspect on the clasp in its totality, can be formed in a relatively simple and economic fashion.

To this effect, the invention has as object a clasp of the unfolding buckle type for bracelets comprising at least one branch and at least one arm hinged at one of its ends to a first end of said branch, said branch having a lateral face arranged opposite a lateral face of said arm in the closed position of the clasp, and means for maintaining the clasp in said closed position, characterized in that the maintaining means comprise at least one elastically deformable element which in the closed position of the clasp extends into a housing formed, on the one hand, by a longitudinal hollow provided in said lateral face of said branch and, on the other hand, by a longitudinal hollow provided in said lateral face of said arm.

Thanks to such characteristics, there is obtained a clasp of simple and economic structure and which exhibits a closing force and an opening force which are constant over the course of time, such latter capable of being readily mastered by adjusting the dimensions and/or the stiffness of the elastically deformable element whatever be the nature of the material or materials used for forming the other parts of the clasp.

BRIEF DESCRIPTION OF THE DRAWINGS

Other characteristics and advantages of the invention will appear more clearly upon reading the following description concerning embodiments of the invention given by way of pure illustration and which are not limiting, such description being prepared in connection with the drawings.

DETAILED DESCRIPTION OF THE INVENTION

Figure 1:
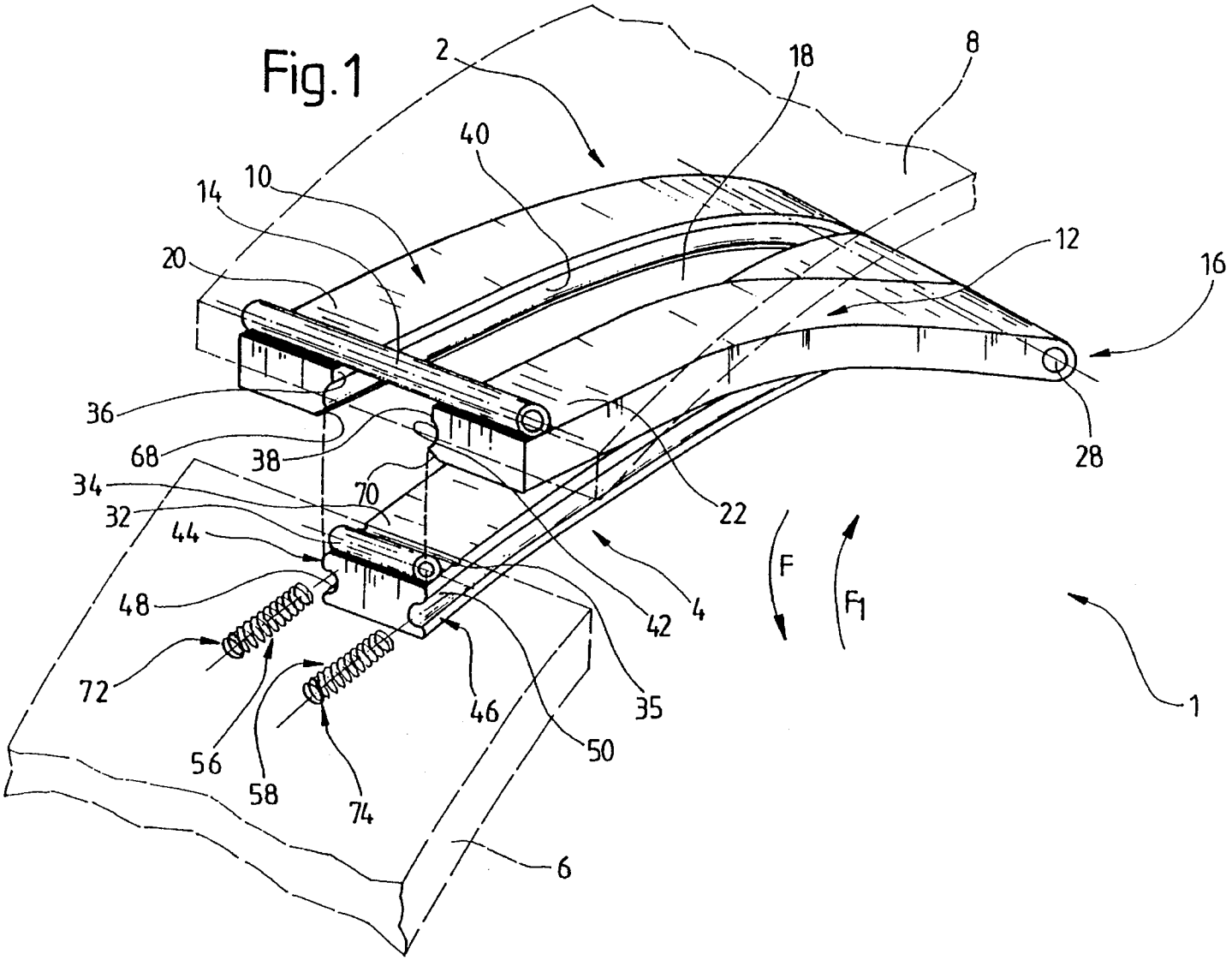
FIG. 1 is a perspective view of an embodiment of a clasp of the invention, the clasp being shown in open position.

FIG. 1 shows, in perspective, a first embodiment of a clasp of the unfolding buckle type according to the invention, and is designated by the general reference numeral 1.

Clasp 1 basically comprises a base 2 and an arm 4. Such elements are hinged onto one another at one of their ends and connected by their other end to first and second bracelet strands 6 and 8. Strands 6 and 8, partially shown in broken lines on the figure, are attached to an object to be worn, in particular a watch (not shown).

Base 2 has the form of a thin elongated blade slightly inwardly curved in the sense of its length in order to be adapted to the curvature of the wrist. Base 2 comprises two parallel branches 10 and 12 coupled together at each of their ends by coupling means 14 and 16 and bounding between them a substantially rectangular longitudinal free space 18. In the example shown, the coupling means 14 are formed by a tube the end portions of which are fixed for example by welding onto the upper surfaces 20 and 22 of one end of branches 10 and 12. Tube 14 is intended to receive a pin (not shown) around which is wrapped the bracelet strand 8 and thus forms means of securing the bracelet strand 8.

Figure 2:
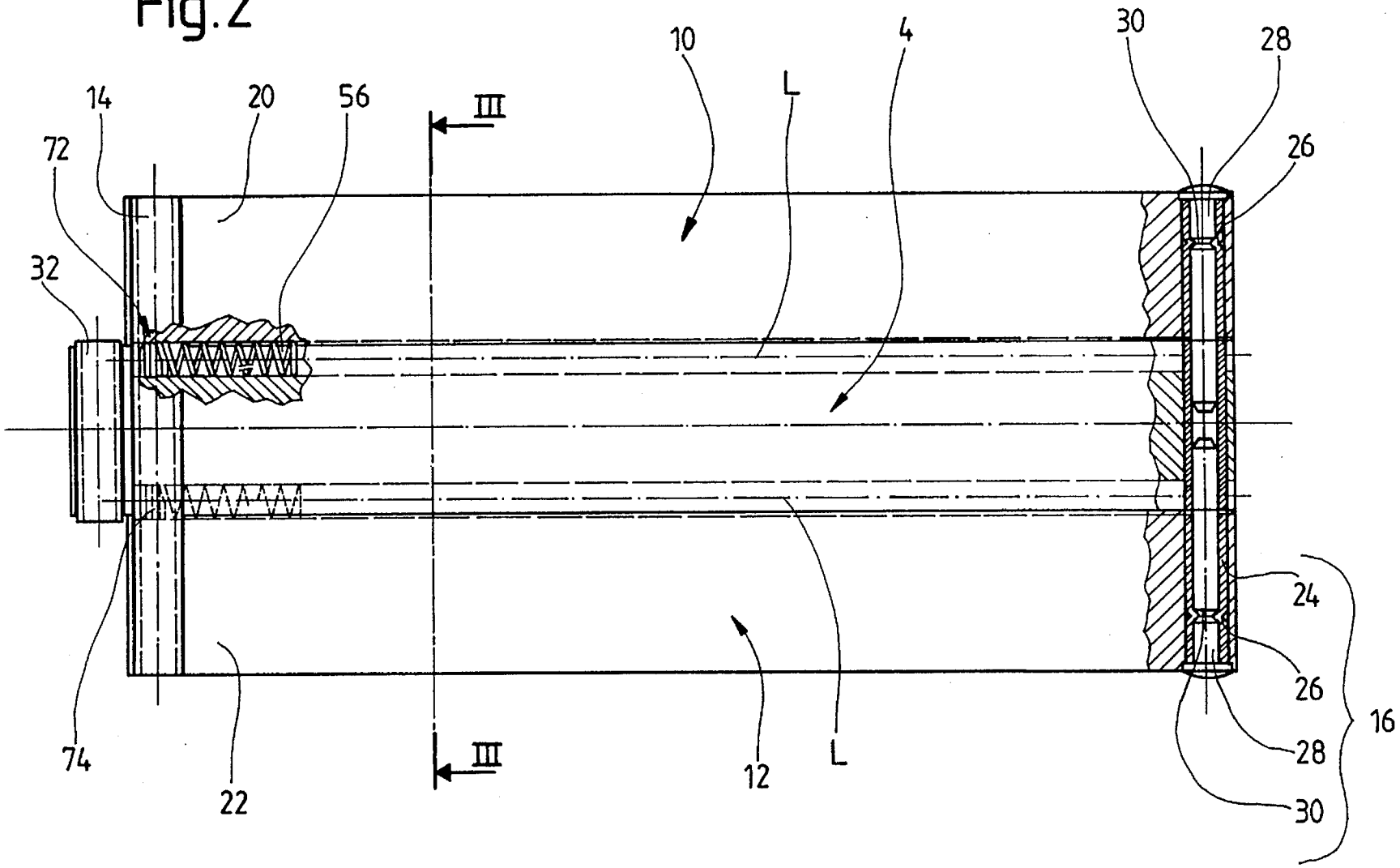
FIG. 2 is a view of the clasp of FIG. 1, the clasp being shown in closed position

The coupling means 16 located at the end of branches 10 and 12 on which is hinged arm 4 comprise a hinge. FIG. 2 indicates one method of forming hinge 16. A tube 24 provided with notches 26 is driven into an opening provided to this end in the other ends of branches 10 and 12 and arm 4 pivots around tube 24. Pins 28, each provided with a groove 30, are introduced into tube 24 and held in place therein through the notches 26 which penetrate into grooves 30. There is thus formed an assembly which is easily assembled and disassembled.

Arm 4 for its part is formed from an elongated blade which has the same thickness and shows the same longitudinal curvature as that of base 2. Of generally rectangular form, its dimensions enable it to take up a place within the free space 18 of base 2. At one end arm 4 is traversed by a hole through which passes the notched tube 24 enabling arm 4 to pivot around tube 24. The other end of arm 4 is provided with securing means 32 for the second bracelet strand 6, also formed by a tube capable of receiving a pin (not shown) around which is wrapped the bracelet strand 6. Tube 32 is secured for example by welding onto an end portion of the upper surface 34 of arm 4.

In the embodiment shown, tube 14 and tube 32 are in particular adapted for the securing of bracelet strands of the type using metallic links, but it is entirely evident that such securing means can be readily modified by persons skilled in the art in order to receive bracelet strands formed, for example, of leather or the like.

In the example described, arm 4 exhibits a length slightly greater than the length of branches 10 and 12 and comprises in its upper surface 34 a transversal groove 35 provided so as, in the closed position of the clasp, to come into coincidence with tube 14 and to receive this latter. Thus, when the clasp is in the closed position, which appears on FIGS. 2 and 3, arm 4 is included in the thickness of branches 10 and 12 with the exception of tube 32 which emerges from the thickness of the clasp at the same level as tube 14. It will be noted that in the embodiment as described, arm 4 can pivot in the sense of arrow F of FIG. 1 in order to bring the clasp into its open position. It is, as is well understood, possible to provide, according to a variant, an arm 4 shorter than branches 10 and 12 so that it is not stopped by tube 14 and can pivot in an opposite sense in order to bring the clasp into its open position. In such case, securing of the bracelet strands onto the base and the arms will be consequently modified.

Clasp 1 further comprises means for maintaining the clasp, that is to say, arm 4 relative to branches 10 and 12, in the closed position. To this effect, branches 10 and 12 each comprise a lateral face 36, 38 in which is provided a longitudinal hollow 40, 42. Arm 4 comprises two opposite lateral faces 44, 46 each being also provided with a longitudinal hollow 48, 50. Each hollow 40 and 42 of branches 10 and 12 is arranged so as to be opposite one of the hollows 48, 50 of the arm in the closed position of the clasp and thus to form two parallel longitudinal housings 52, 54 (note FIG. 3) in each of which extends an elastically deformable element 56, 58.

Each elastically deformable element 56, 58 extends partially into each of the hollows forming its housing 52, 54 so that such elements 56, 58 provide a jamming of ann 4 on branches 10, 12.

In the example shown, the elastically deformable elements 56 and 58 each comprise a helical spring and housings 52 and 54 exhibit a substantially circular cross-section.

The clasp further comprises means for holding each elastically deformable element 56, 58 into one of the hollows forming its housing, in this case in hollows 48 and 50 provided in arm 4 in order that it be retained in said hollow when the clasp is in the open position.

Figure 3:
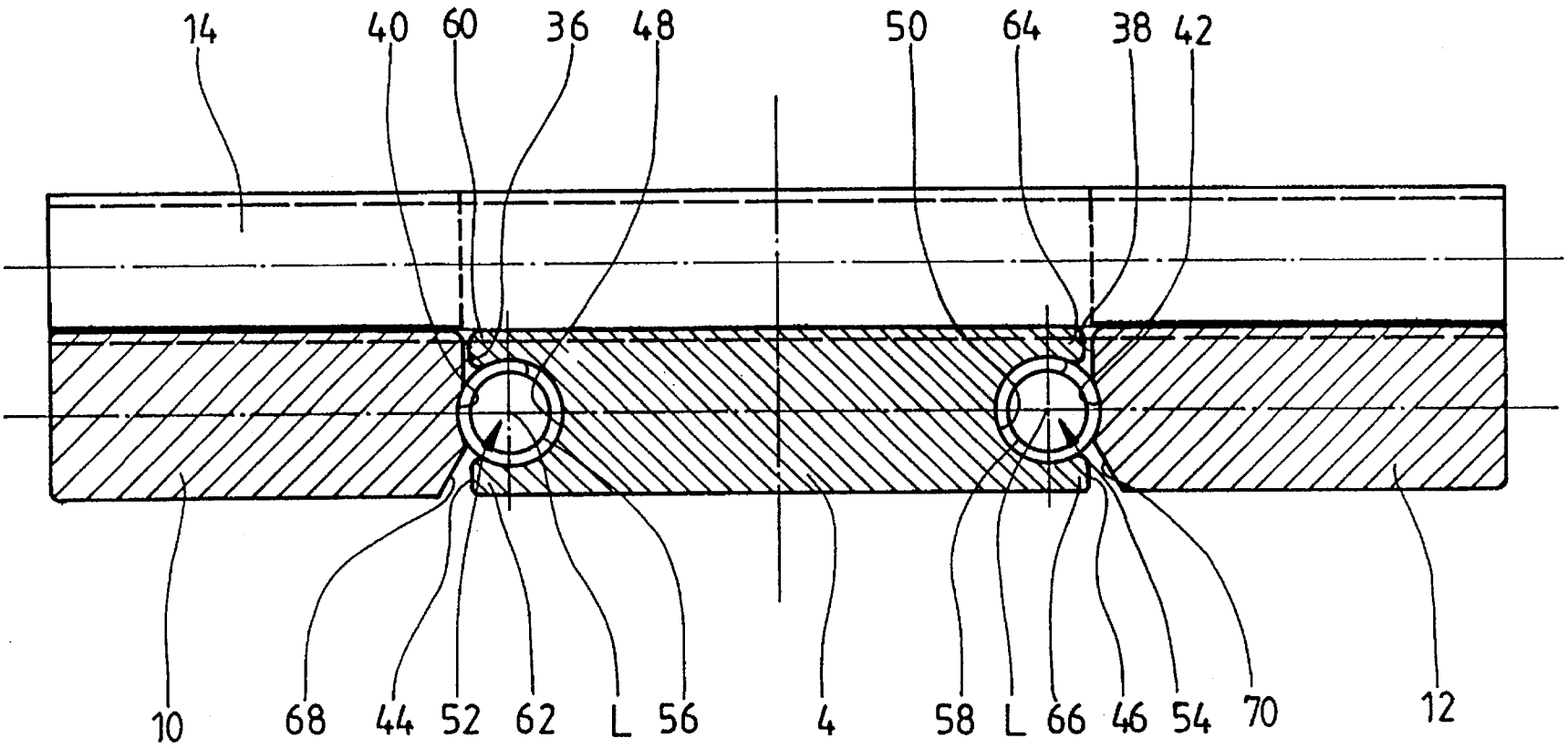
FIG. 3 is a cross-section along line III—III of FIG. 2.

In the example described and as appears clearly on FIG. 3, hollows 48, 50 open out respectively into the lateral faces 44 and 46 of arm 4 through openings bounded by two edges 60, 62 and 64, 66 separated by a distance less than the diameter of the springs 56 and 58. The longitudinal axis L of each of the springs 56, 58 is thus contained in the hollow 48, 50 which receives it. Thus, hollows 48 and 50 extend in cross-section over a circular arc greater than 180° and preferably over an arc of about 240°.

As to hollows 40, 42 provided in the lateral faces of branches 10, 12, these extend in cross-section over a circular arc less than 90° and preferably equal to about 60°.

It is well understood that the hollows 40, 42, 48 and 50 can show different cross-sections and, for example, the cross-section of hollows 48, 50 which retain the elastically deformable elements 56, 58 could be in the form of a dovetail or in T form and the cross-section of complementary hollows 40,42 could be in U of any other form exhibiting a concavity enabling the formation of a housing capable of receiving the elastically deformable elements 56,58.

The diameter of springs 56, 58 is slightly less than the diameter of housings 52, 54 so that there exists a certain play between springs 56, 58 and housings 52, 54 and a fortiori between springs 56, 58 and hollows 48, 50 in which they are held. Springs 56, 58 can thus be deformed without difficulty during the opening and the closing of the clasp 1 as will be described hereinafter.

It will be noted that the lateral faces 36 and 38 of branches 10 and 12 comprise respectively ratcheting ramps 68, 70 provided in the lower portions of such faces. Such ramps 68 and 70 extend respectively from the lower edges of faces 36, 38 to the lower edges of hollows 40, 42. Such ramps 68, 70 enable the elastically deformable elements to be progressively deformed during closing of the clasp as will appear more clearly in the continuation of the description.

Clasp 1 further comprises stopping means 72, 74 for springs 56, 58 in the longitudinal direction in hollows 48, 50. Such stopping means 72, 74 are formed by at least two abutting end coils of springs 56, 58 and the diameter of which when such springs have not been assembled in hollows 48, 50 is substantially greater than that of the housings 52, 54. Thus, springs 56, 58 can easily be introduced into the corresponding hollow 48, 50 by their end having a diameter substantially less than that of the housing, the last coils 72, 74 forming the stopping means in the hollows 48, 50 being thereafter forced into such hollows 48, 50 in order to assure a stop in the longitudinal sense of springs 56, 58 in these hollows. According to a variant, coils 72, 74 forming the stopping means can cooperate respectively with annular grooves (not shown) provided in hollows 48, 50.

The operating principle of the clasp which has just been described is as follows: in the course of closing, the arm, when pushed in the sense of arrow F1, brings about rubbing of the ratcheting ramps 68, 70 of branches 10, 12 onto the portions of springs 56, 58 which project out of hollows 48, 50 which has as effect to deform elastically the Coils of springs 56, 58 in a manner such that they are momentarily pushed aside until such projecting portions of springs 56, 58 penetrate progressively into the complementary hollows 40, 42 provided in branches 10, 12 and thus assure jamming of arm 4 between the two branches 10, 12.

During opening, the arm is pushed in the sense of arrow F and simultaneously acts on the totality of the coils of springs 56, 58 so as to deform them and free arm 4. There results from the structure of the maintaining means that the force to be exerted for opening the clasp is greater than that which is necessary for its closing which gives to the clasp a greater comfort in the use thereof to the wearer and a high security in the closed position.

In connection with this, in order to open the clasp, it will be advantageous to provided the end of strand 8 with a thumbnail groove (not shown).

Furthermore, it will be noted that the forces for closing and opening depend basically from the characteristics of the springs so that such can be easily adjusted. To accomplish this, it suffices to act on the characteristic parameters of each spring, namely the diameter of the wire and the number of coils of the spring.

Figure 4:
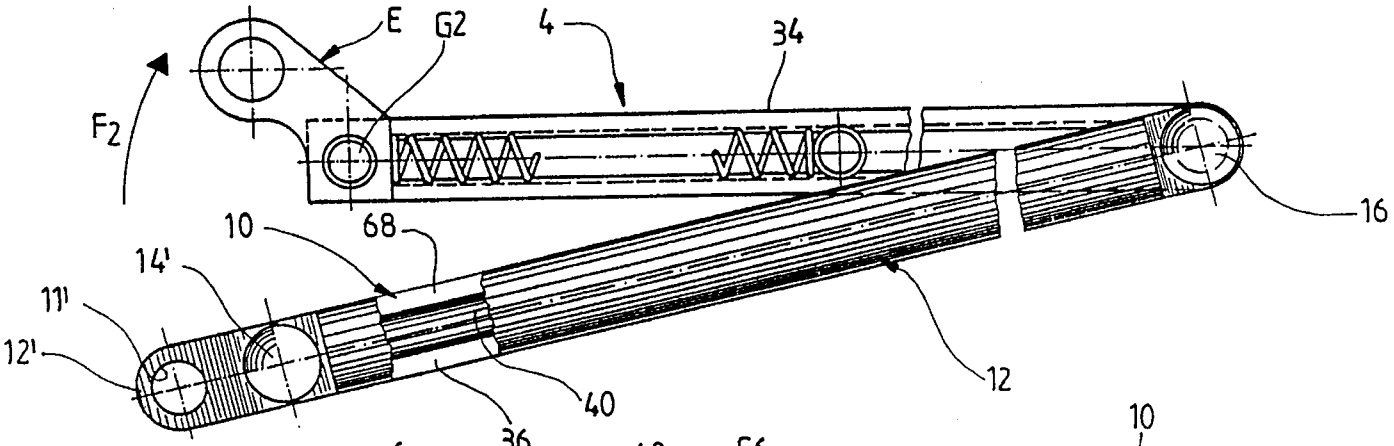
FIG. 4 is a side view partially broken away of a variant of the embodiment of the inventive clasp of FIG. 1, the clasp being shown in open position.
Figure 5:
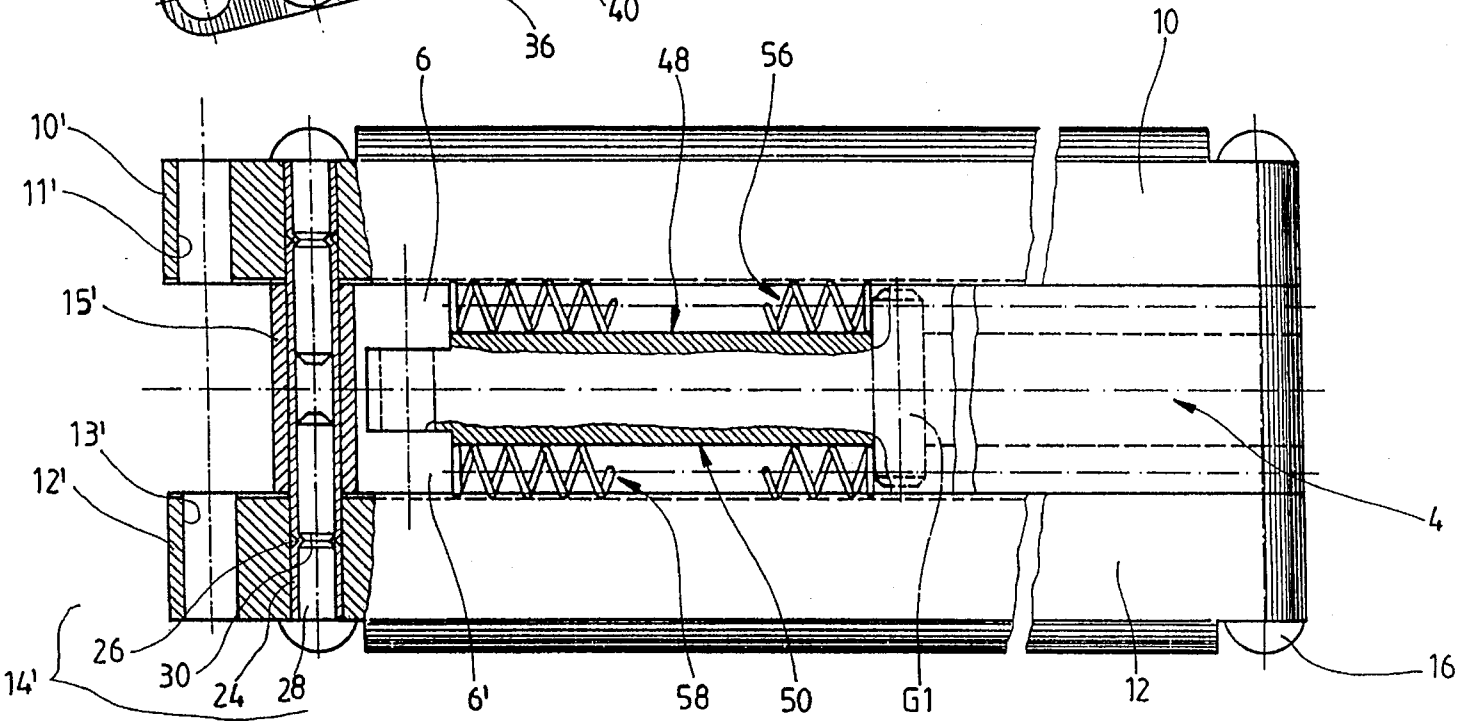
FIG. 5 is a top view and partially cut away of the clasp of FIG. 4, the clasp being shown in closed position

Referring to FIGS. 4 and 5, there is seen a variant of the embodiment of the clasp which is shown on FIGS. 1 to 3 in which the same elements are designated by the same reference numerals.

In a manner different from the first embodiment, the welded tube 14 has been replaced by coupling means 14' of the type of those referenced as 16 on FIG. 2 and in which a tube 15' acts as spacer in order to maintain a suitable distance between the branches 10 and 12 of the clasp.

For the rest, branches 10 and 12 are each extended beyond the coupling means 14' by branch portions 10' and 12'. Each branch portion 10' and 12' comprises a hole 11' and 13' such latter being arranged facing one another and being intended to receive a pin (not shown) for securing a bracelet strand.

In this variant of the embodiment, springs 56 and 58 are respectively stopped longitudinally in the hollows 48 and 50 at a first of their ends by the ends of a pin G1 driven into a hole formed in arm 4, the two ends of the pin extending respectively into the hollows 48 and 50.

For the rest, springs 56 and 58 are respectively held against the ends of pin G1 through an element E secured on arm 4. More specifically, element E comprises a portion in the form of a U the branches 6, 6' of which extend respectively into the hollows 48 and 50 and bear against the second end of springs 56 and 58. The securing of element E on arm 4 is brought about by means of a pin G2 driven into the facing holes provided respectively in ann 4 and in the two branches 6, 6'. As is particularly evident from FIG. 4, element E comprises a second portion referred to as fastening portion extending above the plane of arm 4 and comprising a fastening eyelet intended to receive a pin (not shown) for the fastening of a bracelet strand.

It will be also observed that according to this variant embodiment the opening of the clasp is effected along an upward displacement and in the sense of arrow F2 on the drawing.

Figure 6:
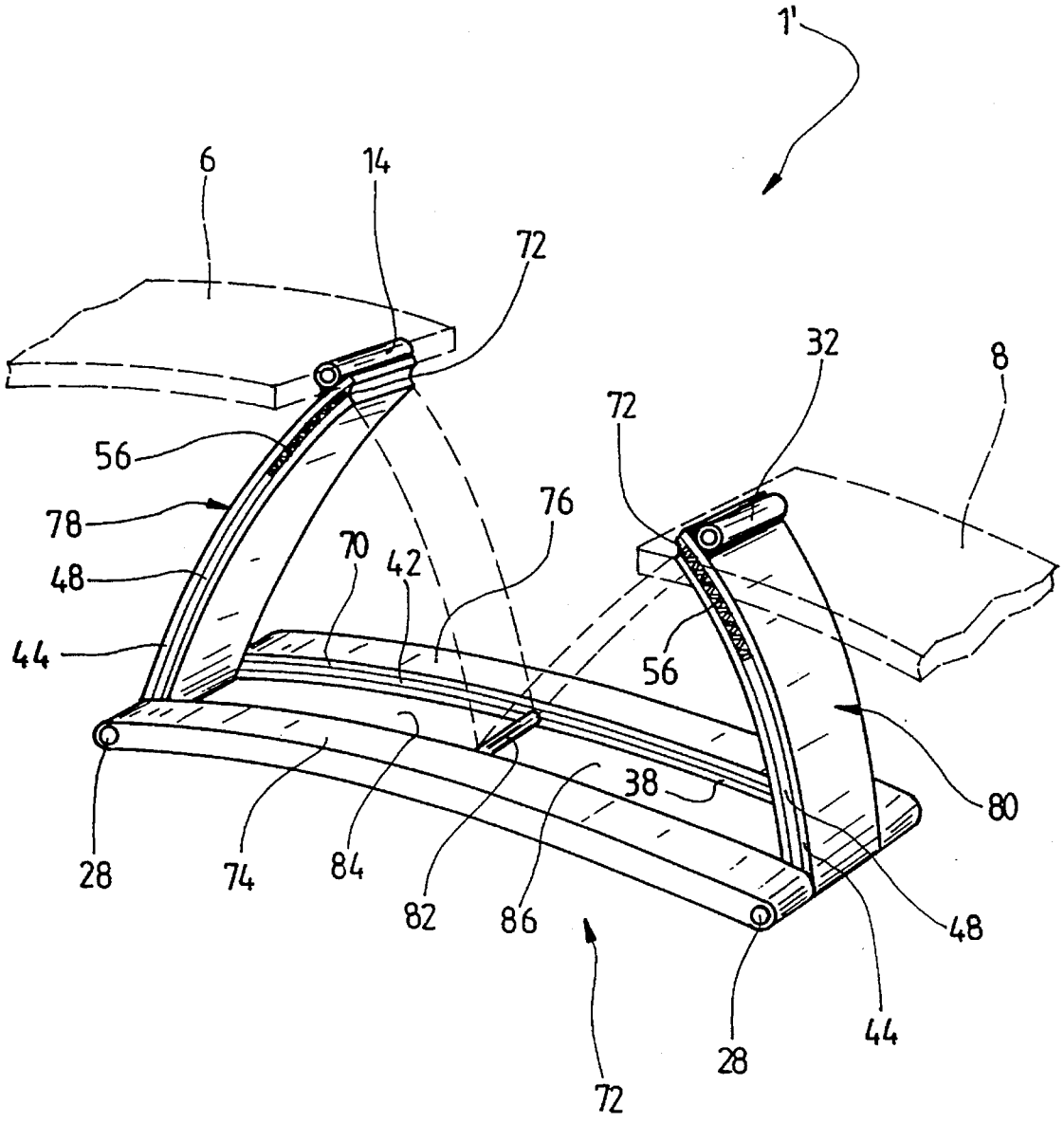
FIG. 6 is a perspective view of a second embodiment of the clasp of the invention, the clasp being shown in the open position.

Referring now to FIG. 6, there is seen a second embodiment in which the same elements as those shown on FIGS. 1 to 5 are designated by the same reference numerals.

In this second embodiment, clasp 1' comprises a base 72 formed from two parallel branches 74, 76 and two arms 78 and 80 hinged at one of their ends to the ends of branches 74, 76. The other ends of arms 78 and 80 comprise respectively securing means 14, 32 for a bracelet strand 6, 8 shown partially in broken lines on the figure.

Clasp 1' further comprises a stiffening element 82 coupling branches 74 and 76 in their median zone which bounds, together with branches 74, 76 two free spaces 84, 86 of generally rectangular form in which arms 78, 80 can be respectively included in the closed position of the clasp, the ends of the arms coupled to the bracelet strands then being substantially juxtaposed.

Such clasp 1' can thus be considered as being formed by two clasps 1 such as shown on FIGS. 1 to 3 coupled to one another by one of their ends and utilizing the same maintaining means as those which have been described in connection with such figures.

The clasps of the invention exhibit the advantage of very easy fabrication since, for the branches, as for the arm or arms, these elements can be obtained from sections which are blanked, curved and assembled. There are thus no stamping operations with the losses of material and tooling costs which such bring about. The clasp of the invention shows furthermore a simple line conferring great elegance thereto.

It is well understood that the invention is not limited to the embodiments which have just been described and that numerous variants which are evident to the person skilled in the art can be obtained without departing from the framework of the present invention defined by the attached claims. There can, for example, be foreseen maintaining means exhibiting only a single housing cooperating with a single elastically deformable element. It can also be foreseen that the elastically deformable element not be in the form of a helical spring, but in the form of a cylinder of an elastomeric material or again from a tube of an elastically deformable material, that the elastically deformable elements not be held in the arm or arms, but in the branches, or again that the clasp comprise only a single branch and an arm hinged thereto at their ends.

What is claimed is:

1. A clasp of the unfolding buckle type for bracelets, said clasp comprising at least one branch and at least one arm hinged at one of its ends to a first end of said branch, said branch having a side portion providing a lateral side face arranged opposite a lateral side face provided by a side portion of said arm in a closed position of the clasp, and maintaining means for maintaining the clasp in said closed position, said maintaining means comprising at least one elastically deformable element which in the closed position of the clasp extends into a housing formed by a longitudinal hollow provided in said lateral side face of said branch and by a longitudinal hollow provided in said lateral side face of said arm.

2. A clasp according to claim 1, wherein said elastically deformable element is retained in a first of said hollows formed in a first of said lateral side faces by holding means.

3. A clasp according to claim 2 further comprising a second branch substantially parallel to the first branch, said first and second branches being coupled together at one of their ends by connecting means and separated from one another by a free space capable of receiving at least partially said arm in the closed position of the clasp, and said second branch exhibiting a lateral side face arranged opposite a second lateral side face of said arm.

4. A clasp according to claim 3, wherein said first hollow is formed in said lateral side face of said arm.

5. A clasp according to claim 4 further comprising a second elastically deformable element extending in the closed position of the clasp into a second housing formed by a hollow provided in said lateral side face of the second branch and by a hollow provided in said second lateral side face of said arm.

6. A clasp according to claim 3 further comprising a second arm hinged at a first end to a second end of each of said branches, second ends of said first and second arms being substantially juxtaposed in the closed position of the clasp.

7. A clasp according to claim 6, wherein said second ends of said arms comprise securing means for a bracelet strand.

8. A clasp according to claim 7, further comprising a transversal stiffening element coupling the first and second branches.

9. A clasp according to claim 2 wherein said elastically deformable element comprises a helical spring.

10. A clasp according to claim 9, wherein the longitudinal axis of said spring is contained in said first hollow, and wherein said first hollow opens out into said first lateral face through an opening bounded by two edges separated by a distance less than the diameter of the spring, said holding means being constituted by said edges.

11. A clasp according to claim 10, wherein the housing formed by the hollows exhibits a circular cross-section.

12. A clasp according to claim 11, wherein the diameter of the spring is substantially equal to the diameter of the housing.

13. A clasp according to claim 1, wherein said elastically deformable element comprises a helical spring.

14. A clasp according to claim 13, wherein the longitudinal axis of said spring is contained in said first hollow, and wherein said first hollow opens out into said first lateral side face through an opening bounded by two edges separated by a distance less than the diameter of the spring, said holding means being constituted by said edges.

15. A clasp according to claim 14, wherein the housing formed by the hollows exhibits a circular cross-section.

16. A clasp according to claim 15, wherein the diameter of the spring is substantially equal to the diameter of the housing.

17. A clasp according to claim 16, further comprising stopping means for the spring in the longitudinal direction thereof within said first hollow.

18. A clasp according to claim 15 further comprising stopping means for the spring in the longitudinal direction thereof within said first hollow.

19. A clasp according to claim 18, wherein said spring comprises at least two abuting end coils the diameter of which is substantially greater than the diameter of said housing prior to the assembly of said spring within said first hollow.

20. A clasp according to claim 1, wherein a second end of said branch and a second end of said arm comprise securing means for a bracelet strand.

* * * * *